US005694878A

United States Patent [19]

Masuyama

[11] Patent Number: 5,694,878

[45] Date of Patent: Dec. 9, 1997

[54] SEMI-SUBMERGED CATAMARAN

[75] Inventor: Kazuo Masuyama, Tokyo, Japan

[73] Assignee: Mitsui Engineering & Shipbuilding Co., Ltd., Tokyo, Japan

[21] Appl. No.: 612,835

[22] PCT Filed: Feb. 17, 1995

[86] PCT No.: PCT/JP95/00224

§ 371 Date: Mar. 18, 1996

§ 102(e) Date: Mar. 18, 1996

[87] PCT Pub. No.: WO96/03310

PCT Pub. Date: Feb. 8, 1996

[30] Foreign Application Priority Data

Jul. 21, 1994 [JP] Japan ..... 6-169715

[51] Int. Cl.[6] ..... B63H 19/02; B63B 1/12

[52] U.S. Cl. ..... 114/61; 114/126

[58] Field of Search ..... 114/61, 126, 265, 114/292; D12/300, 308, 309, 304

[56] References Cited

U.S. PATENT DOCUMENTS

| | | | |
|---|---|---|---|
| 3,063,397 | 11/1962 | Boericke, Jr. | 114/126 |
| 3,817,199 | 6/1974 | Schirtzinger | 114/265 |
| 4,174,671 | 11/1979 | Seidl | 114/265 |
| 4,763,596 | 8/1988 | Yoshida | 114/265 |
| 4,986,204 | 1/1991 | Yoshida | 114/126 |
| 5,301,624 | 4/1994 | Hall et al. | 114/61 |

FOREIGN PATENT DOCUMENTS

| | | | |
|---|---|---|---|
| 2988 | 1/1977 | Japan | 114/265 |
| 99872 | 8/1981 | Japan | 114/61 |
| 0120473 | 9/1981 | Japan | 114/61 |
| 4487 | 1/1982 | Japan | 114/61 |
| 0292587 | 12/1987 | Japan | 114/265 |
| 1627445 | 2/1991 | U.S.S.R. | 114/265 |

*Primary Examiner*—Edwin L. Swinehart

*Attorney, Agent, or Firm*—Nikaido, Marmelstein, Murray & Oram LLP

[57] ABSTRACT

In a semi-submerged catamaran comprising at least two submerged bodies, struts mounted in a standing position on respective submerged bodies and a hull part supported by the struts above the water surface, motion preventing fins are fixed in a submerged part on the bow side and/or in a submerged part on the stern side of the catamaran.

17 Claims, 7 Drawing Sheets

SEMI-SUBMERGED CATAMARAN

ART FIELD

The present invention relates to a semi-submerged catamaran which comprises a relatively thin and long submerged body to exhibit an improved speed characteristic but of which the susceptivity of motion at stoppage is nevertheless suppressed.

BACKGROUND ART

Generally, semi-submerged catamarans comprise at least two submerged bodies which are normally immersed in water, a strut mounted in a standing position on respective submerged bodies, and a hull part normally maintained above the water surface.

As one of means for improving the speed characteristic of semi-submerged catamarans of the mentioned type, it is conceivable to design the submerged bodies to be relatively thin and long.

If the submerged body is excessively elongated, however, the natural period of pitching tends to be so short that the possibility of resonance between wave and motion of the catamaran is increased. Also, as a result of the submerged body being thin or slender, the configuration the submerged part comprising the struts and the submerged bodies is no longer within the category of so-called "waveless configurations" which are regarded as not undergoing influences of waves.

Thus, even with semi-submerged catamarans which are generally accepted as being desirable with respect to the motion characteristic, the susceptivity of motion at stoppage tends to be relatively large if the submerged bodies are extremely elongated.

Then, it is also conceivable to limit the elongation of the submerged body so that the submerged body does not fall outside the category of the "waveless configuration", but a difficulty comes out then to do with the designing and building.

It further is conceivable to size up the existing stabilizing fins, but in this case the added resistance of the catamaran tends to be too large. Also, stabilizing fins are usually movable, so that if they are increased in size, this gives rise to a problem that a size-up has to be made of for example an actuator for driving the stabilizing fins.

Moreover, the stabilizing fins and the center of gravity of the catamaran are not largely spaced from each other, so that even if the size of the stabilizing fins is increased, pitching at stoppage of the catamaran cannot be effectively suppressed.

DISCLOSURE OF THE INVENTION

The present invention has been made in order to obviate the above indicated difficulties and problems, and the primary object of the invention is to provide such a semi-submerged catamaran of which the speed characteristic is improved as a result of an elongation of its submerged bodies and yet the susceptivity of motion at stoppage is considerably suppressed.

That is to say, the present invention consists in a semi-submerged catamaran which comprises at least two submerged bodies, a strut mounted in a standing position on respective submerged bodies and a hull part supported by the struts at a position above the water surface, and which is characterized in that it further comprises motion preventing fins fixed in a submerged part on the bow side and/or a submerged part on the stern side of the catamaran.

The submerged part termed herein refers to such a part of the catamaran which comprises a submerged portion of respective struts and the submerged bodies and which normally immersed in water.

Attributable to the above described structuring, even in connection with such a semi-submerged catamaran of which the submerged body is relatively largely elongated to attain an improvement in or relating to the speed characteristic, it is possible to increase the damping power and greatly reduce the susceptivity of motion, particuarly pitching, of the catamaran at stoppage.

Preferably the length of the motion preventing fins is 5 to 20% or, more preferably, 7 to 15% of the length of the semi-submerged catamaran.

Also, the width of the motion preventing fins is preferably 10 to 1,000 mm or, more preferably, 100 to 500

BRIEF DESCRIPTION OF THE DRAWINGS

As shown in FIG. 2, stabilizing fins 5A are provided on the side of the bow of submerged bodies, while stabilizing fins 5B are provided on the stern side.

Figure 1:
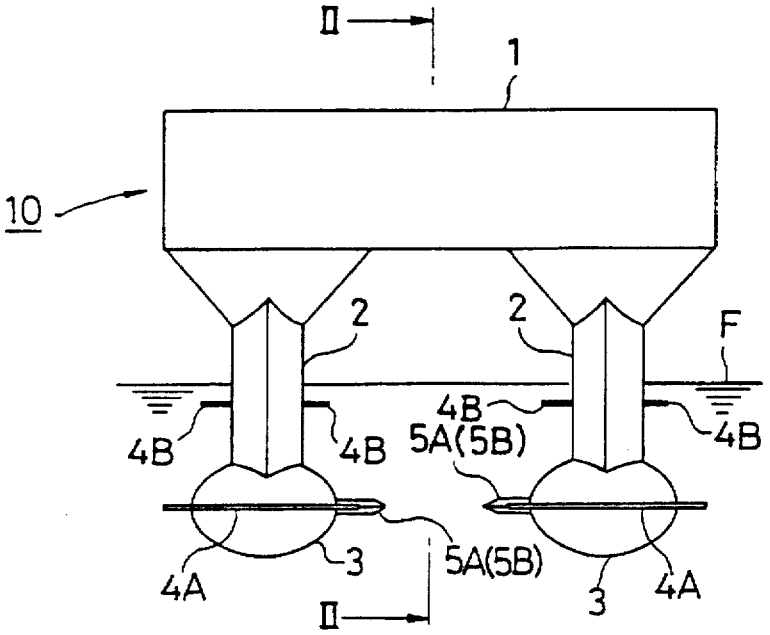
FIG. 1 shows a front elevation of a semi-submerged catamaran pertaining to the present invention.
Figure 2:
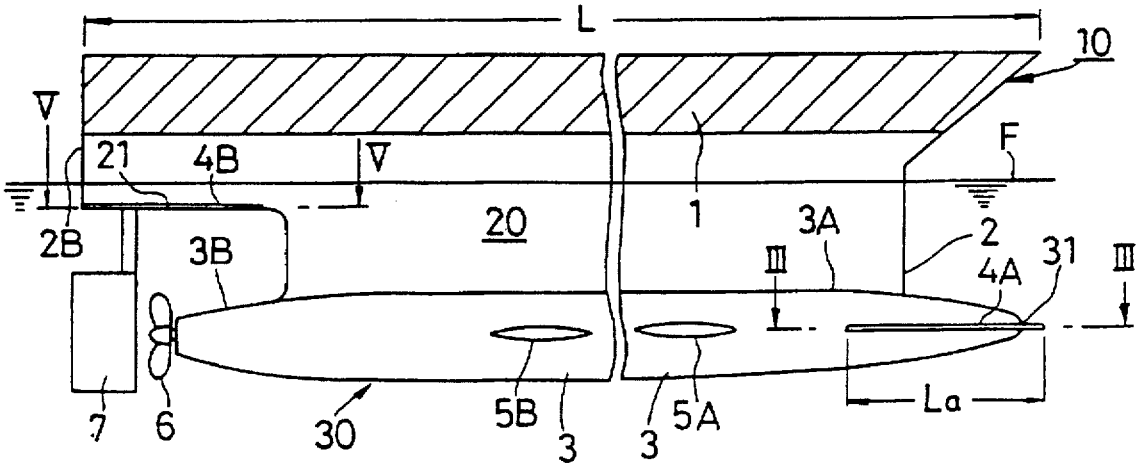
FIG. 2 is a sectional view, taken on line II—II of FIG. 1.

Further, as seen from FIG. 1 and FIG. 2, motion preventing fins 4A are fixed at a bow portion 3A of respective submerged bodies 3. Also, the underside shown at 21 of a stern portion 2B of a strut 2 located above a screw propeller 6 is normally submerged, so that motion preventing fins 4B are fixed to the underside 21 of the stern portion 2B.

Further, the reference numeral 7 denotes a rudder.

Such a part of the catamaran which comprises a submerged portion 20 of respective struts 2 which normally is submerged and the submerged bodies 3 and which is normally submerged is herein referred to as submerged part 30 of the catamaran.

As seen with reference to FIG. 1, fins 4A are provided in a horizontal position in the part of a major diameter of the respective submerged bodies 8 formed to have an almost elliptical shape in cross-section, namely in the part of respective submerged bodies 3 in which the bodies 3 have a maximum width.

Figure 3:
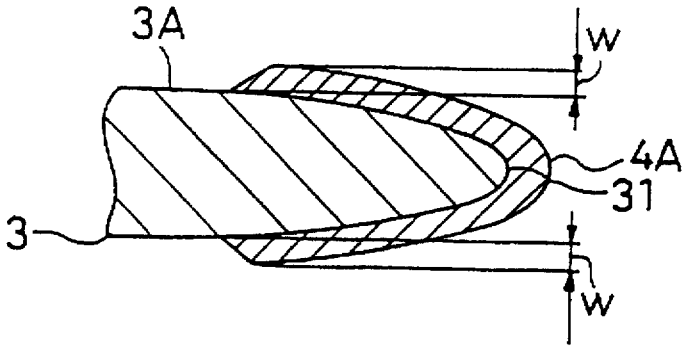
FIG. 3 is a sectional view, taken on line III—III of FIG. 2.
Figure 5:
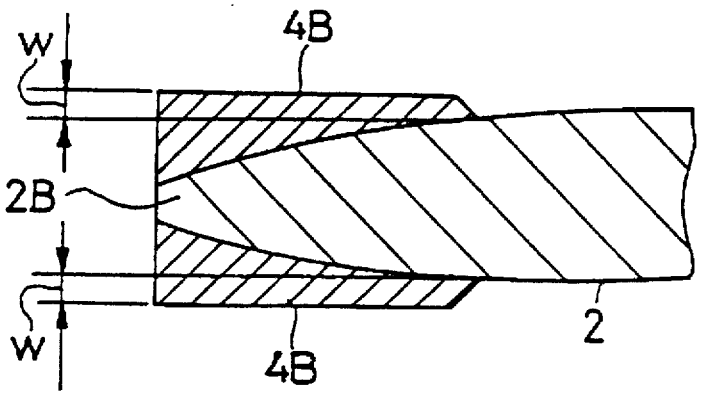
FIG. 5 is a sectional view, taken on line V—V of FIG. 2.

As shown in FIG. 3, the fin 4A is mounted in a manner of surrounding a leading end portion of the submerged body 3, along an inner side part and an outer side part of the body 3, and as shown in FIG. 5, fins 4B are attached in a manner such that their rear ends and the rear end of the strut 2 correspond to each other in position, whereby a fairly large distance can be secured between the center of gravity of the catamaran and the fins 4A and 4B. Consequently, the damping effect can be enhanced and the motion, particularly the pitching, of the catamaran at stoppage can be reduced.

Figure 4:
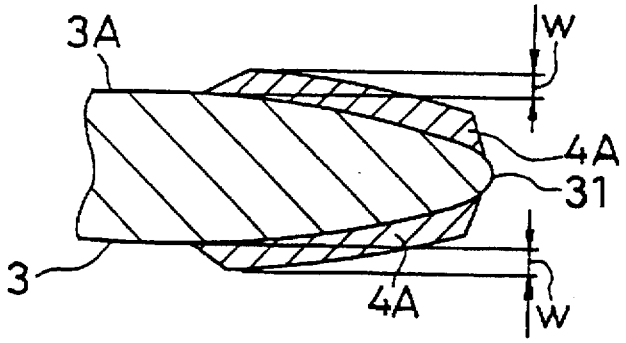
FIG. 4 is a view, taken for illustration of another example of the bow portion fin.

As shown in FIG. 4, separate fins 4A may be attached, one along an inner side and the other along an outer side in the bow part 3A of the submerged body 3.

Figure 6:
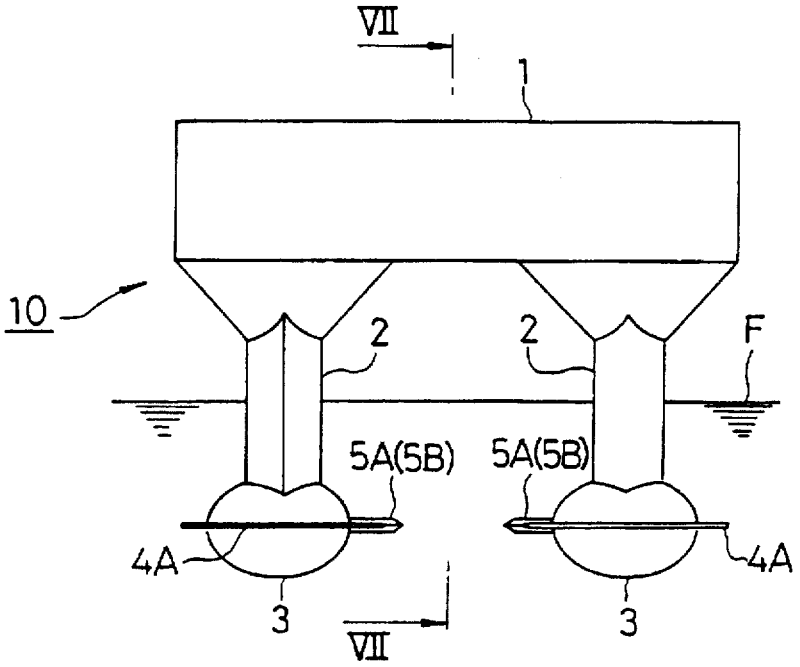
FIG. 6 is a front elevational view, showing another embodiment of the semi-submerged catamaran pertaining to the present invention.
Figure 7:
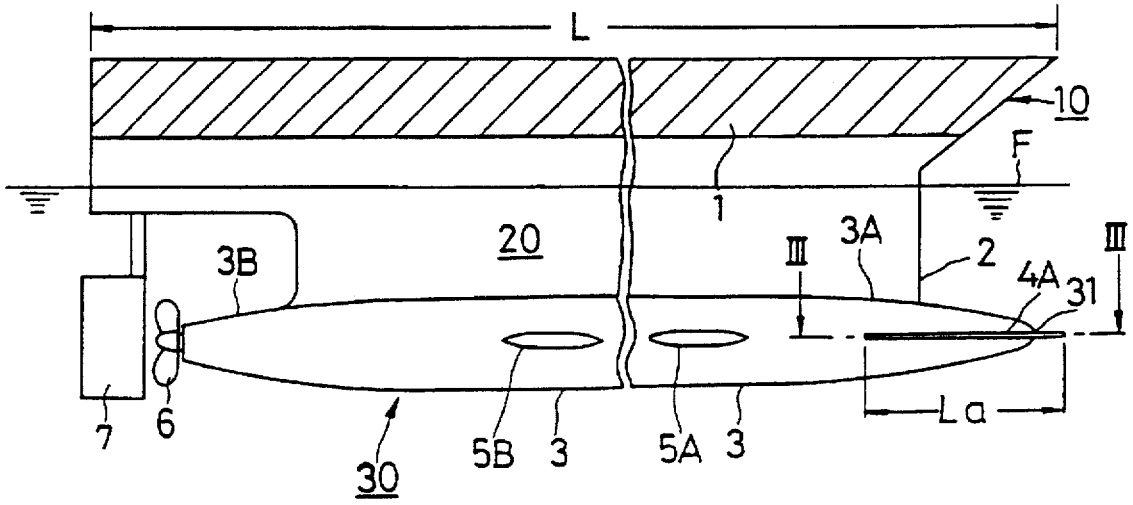
FIG. 7 is a sectional view, taken on line VII—VII of FIG. 6.

Alternatively, the motion preventing fins 4A may be fixed in the bow part 3A of respective submerged bodies 3 as shown in FIG. 6 and FIG. 7.

Figure 8:
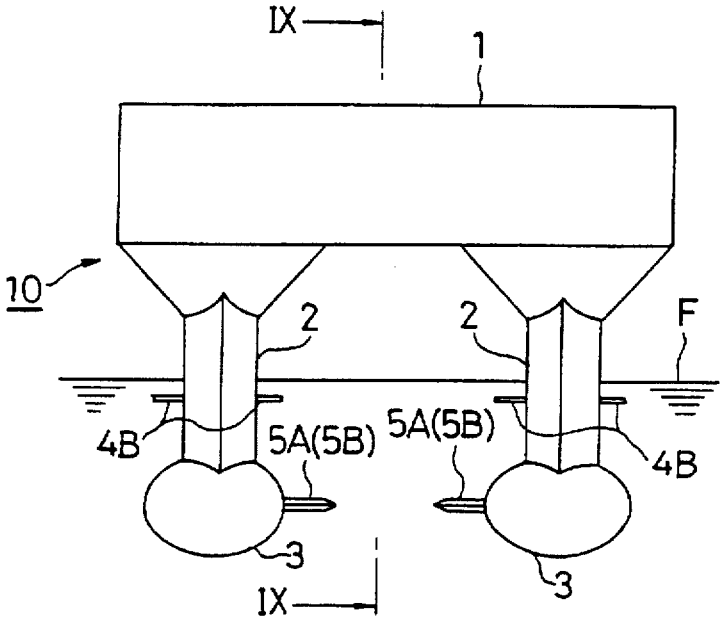
FIG. 8 is a front elevation, showing still another embodiment of the semi-submerged catamaran pertaining to the present invention.
Figure 9:
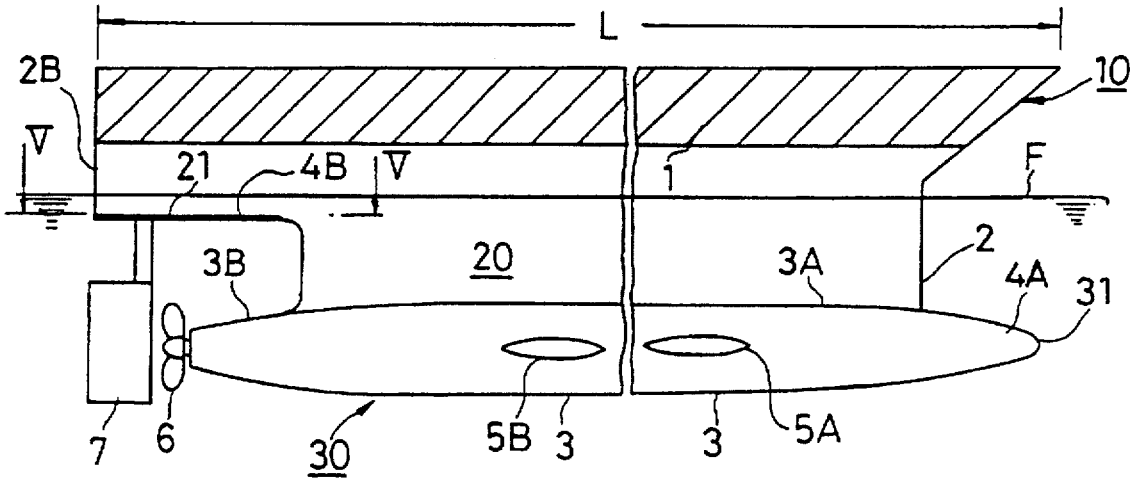
FIG. 9 is a sectional view, taken on line IX—IX of FIG. 8.

Otherwise, as shown in FIG. 8 and FIG. 9, motion preventing fins 4B may be fixed on the underside 21 in the stern part 2B of respective struts 2 which are normally submerged.

Figure 10:
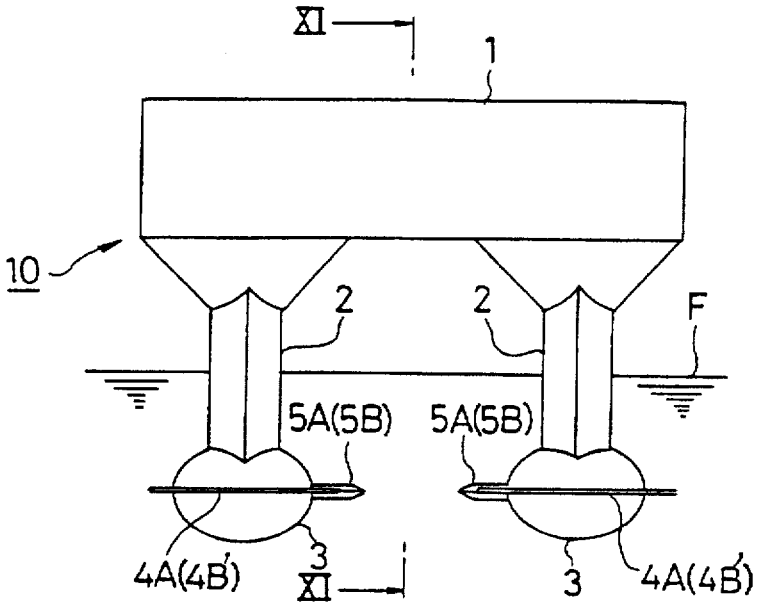
FIG. 10 is a front elevation of a still another embodiment of the semi-submerged catamaran pertaining to the present invention.
Figure 11:
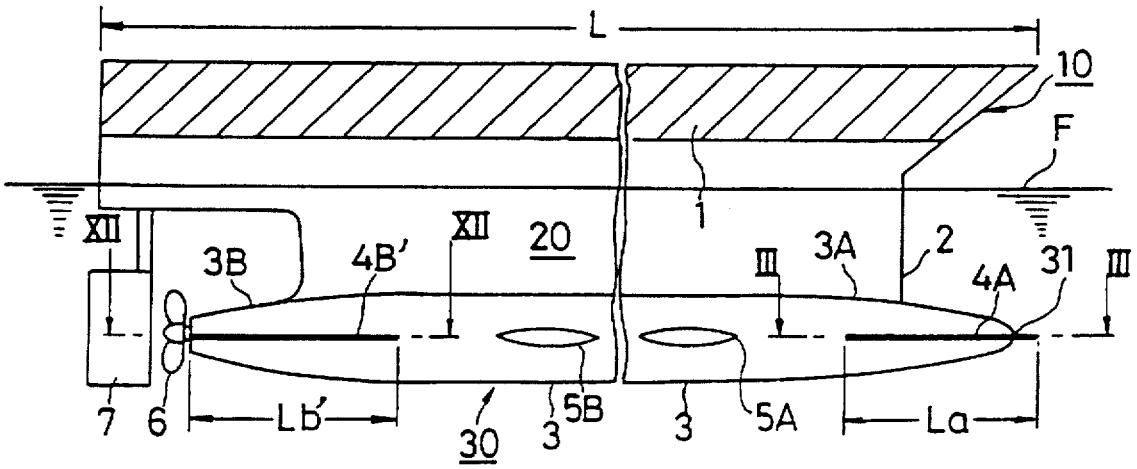
FIG. 11 is a sectional view, taken on line XI—XI of FIG. 10.
Figure 12:
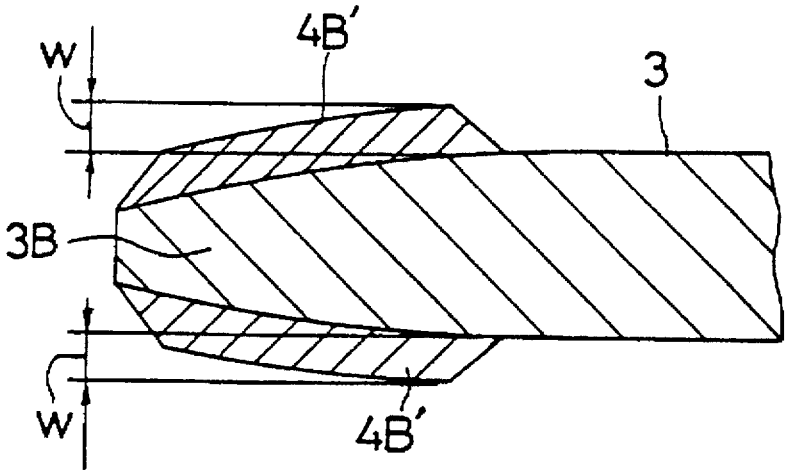
FIG. 12 is a sectional view, taken on line XII—XII of FIG. 11.

As shown in FIG. 10 and FIG. 11, further, it may be devised to fix motion preventing fins 4A in the bow part 3A of respective submerged bodies and, in addition, fix motion preventing fins 4B' in the stern part 3B of respective submerged bodies 3. In this case, separate fins 4B' are attached along the inner side and the outer side in the stern part 3B. of respective submerged bodies 3 as shown in FIG. 12.

Figure 13:
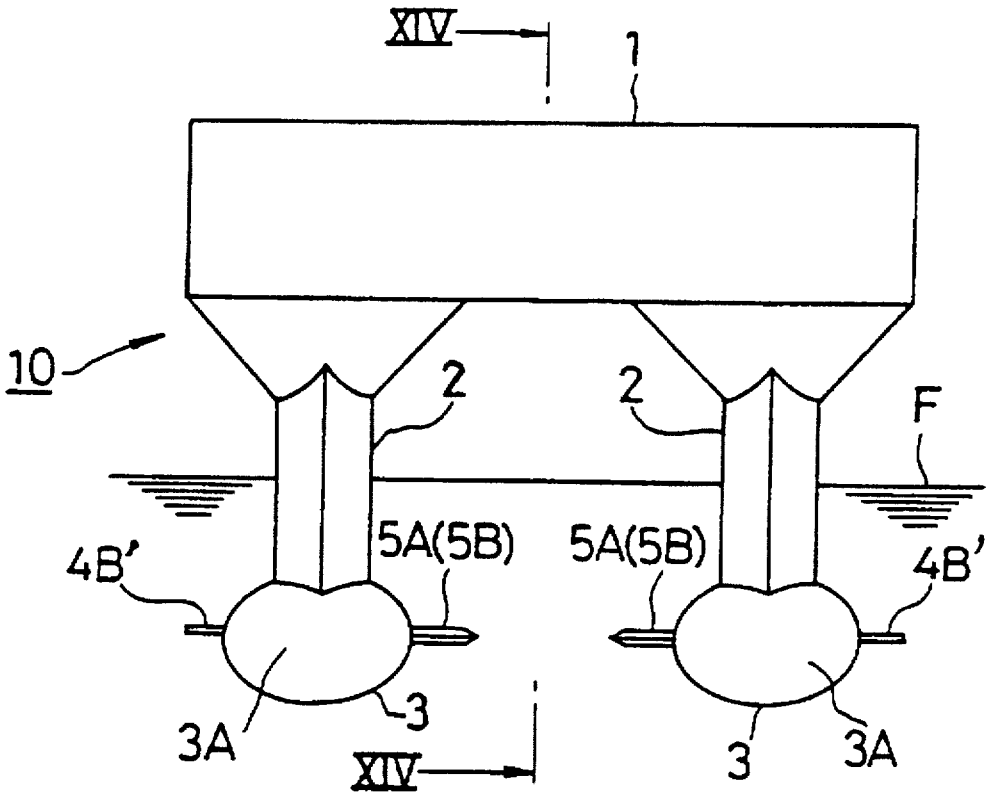
FIG. 13 is a front elevation of yet still another embodiment of the semi-submerged catamaran pertinent to the present invention.
Figure 14:
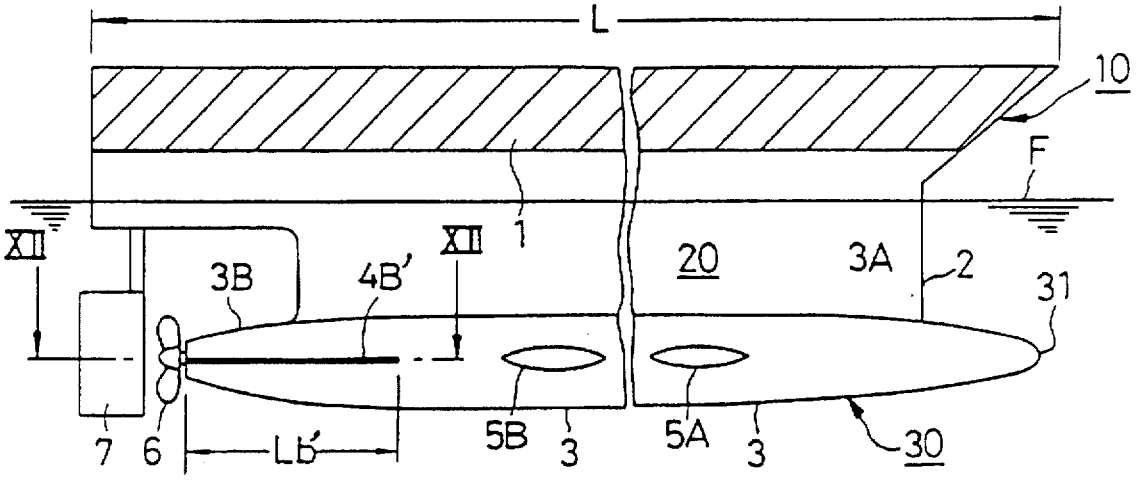
FIG. 14 is a sectional view, taken on line XIV—XIV of FIG. 13.

As shown in FIG. 13 and FIG. 14, it is also possible to fix motion preventing fins 4B' in the stern part B of respective submerged bodies 3.

The length La of fins 4A, the length Lb of fins 4B and the length Lb' of fins 4B' are preferably 5 to 20% or, more preferably, 7 to 15% of the length L of the semi-submerged catamaran indicated at 10.

If the lengths La, Lb and Lb' of fins 4A, 4B and 4B' are less than 5%, the effect of motion damping cannot be fully exhibited.

On the other hand, if the lengths La, Lb and Lb' of fins 4A, 4B and 4B' exceed 20%, the added resistance of the catamaran tends to be too large.

Then, in connection with the width w of fins 4A, 4B and 4B', although it depends on the thickness of the submerged body 3 or the diameter of the circumscribed circle of the submerged body 3, preferably it should be such that a single plate can be applied to attain the width w or, in other words, 10 to 1,000 mm or, more preferably, 100 to 500 mm.

If the width w of fins 4A, 4B and 4B' does not reach 10 mm, no sufficient effect of motion damping can be exhibited. On the other hand, if this width w exceeds 1,000 mm, not only the added resistance of the catamaran tends to be too large but also a problem is likely to do with the strength.

Figure 15:
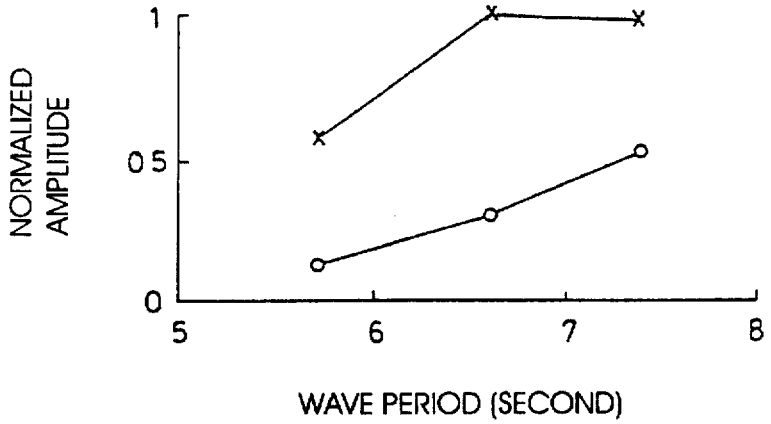
FIG. 15 is a diagram, showing heaving motion at a bow portion of a semi-submerted catamaran at stoppage.
Figure 16:
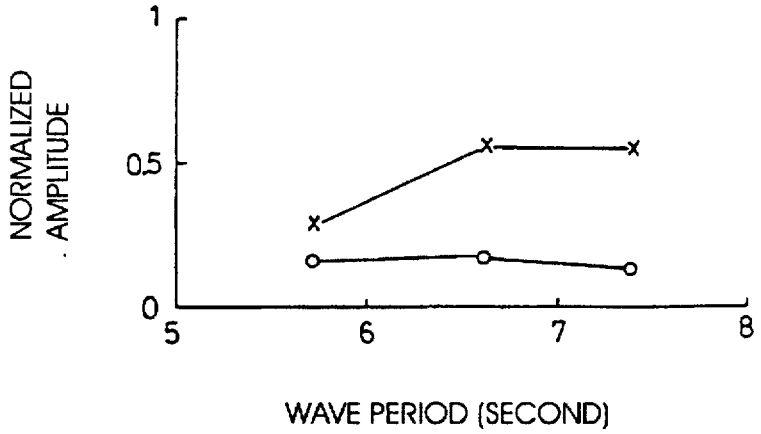
FIG. 16 is a diagram, showing heaving motion at a stern portion of the semi-submerged catamaran at stoppage.

Shown in FIG. 15 and FIG. 16 in order to further illustrate the present invention are results of water tank tests conducted of a semi-submerged catamaran pertaining to the present invention.

FIG. 15 shows heaving motion at the bow of the catamaran at stoppage, while FIG. 16 showing heaving motion at the stern of the catamaran at stoppage.

It is seen that when motion preventing fins are provided as according to the present invention, the motion at the bow part or the stern part can be suppressed to ⅓ to ½ when compared with the case of no fin provision.

In FIG. 15 and FIG. 16, further, the —x— lines represent characteristics where fins were not attached, while the —o— lines represent characteristics where fins were attached.

What is claimed is:

1. A semi-submerged catamaran comprising at least two submerged bodies, at least two struts, each strut being mounted in a standing position on one of said submerged bodies, a hull part supported by the struts above the water surface, stabilizing fins on a lateral inner part of each of said at least two submerged bodies at abow side and at a stern side of said at least two submerged bodies, and motion preventing fins fixed on at least a bow portion of said submerged bodies of the catamaran, each of said motion preventing fins fixed on the bow portion being a flat plate provided on the body in a horizontal position at which the body has a maximum horizontal width at the bow side, said flat plate extending forwardly of the bow side of the submerged body.

2. A semi-submerged catamaran as claimed in claim 1, wherein a length of the motion preventing fins is 5 to 20% of a length L of the catamaran.

3. A semi-submerged catamaran as claimed in claim 1, wherein the motion preventing fins have a width w which is 10 to 1000 mm.

4. A semi-submerged catamaran as claimed in claim 2, wherein said length of the motion preventing fins is 7 to 15% of a length L of the catamaran.

5. A semi-submerged catamaran as claimed in claim 3, wherein said width w is 100 to 500 mm.

6. A semi-submerged catamaran as claimed in claim 1, further comprising additional motion preventing fins fixed on a stern portion of the struts, each of said additional motion preventing fins being a flat plate fixed horizontally to an underside of a stern portion of the strut located above a screw propeller and a rudder of the catamaran.

7. A semi-submerged catamaran comprising at least two submerged bodies, at least two struts, each strut being mounted in a standing position on one of said submerged bodies, a hull part supported by the struts above the water surface, stabilizing fins on a lateral inner part of each of said at least two submerged bodies at a bow side and at a stern side of said at least two submerged bodies, and motion preventing fins fixed on at least a stern portion of said submerged bodies of the catamaran, each of said motion preventing fins fixed on said stern portion of the submerged bodies being a flat plate provided on the body in a horizontal position at which the body has a maximum horizontal width at the stern side.

8. A semi-submerged catamaran as claimed in claim 7, wherein a length of the motion preventing fins is 5 to 20% of a length L of the catamaran.

9. A semi-submerged catamaran as claimed in claim 8, wherein said length of the motion preventing fins is 7 to 15% of a length L of the catamaran.

10. A semi-submerged catamaran as claimed in claim 7, wherein the motion preventing fins have a width w which is 10 to 1000 mm.

11. A semi-submerged catamaran as claimed in claim 10, wherein said width w is 100 to 500 mm.

12. A semi-submerged catamaran comprising at least two submerged bodies, at least two struts, each strut being mounted in a standing position on one of said submerged bodies, a hull part supported by the struts above the water surface, stabilizing fins on a lateral inner part of each of said at least two submerged bodies at a bow side and at a stern side of said at least two submerged bodies, and motion preventing fins fixed on a submerged part on the bow side and a submerged part on the stern side of the catamaran, each of said motion preventing fins that are fixed on the bow side of the submerged part being a flat plate provided on the body in a horizontal position at which the submerged body has a maximum horizontal width at the bow side, said flat plate extending forwardly of the bow side of the submerged body.

13. A semi-submerged catamaran as claimed in claim 12, wherein each of said motion preventing fins that are fixed on the stern side of the submerged part is a flat plate provided in a horizontal position at which the submerged body has a maximum horizontal width at the stern side.

14. A semi-submerged catamaran as claimed in claim 12 wherein a length of the motion preventing fins is 5 to 20% of a length L of the catamaran.

15. A semi-submerged catamaran as claimed in claim 12 wherein the motion preventing fins have a width w which is 10 to 1000 mm.

16. A semi-submerged catamaran as claimed in claim 14, wherein said length of the motion preventing fins is 7 to 15% of a length L of the catamaran.

17. A semi-submerged catamaran as claimed in claim 15, wherein said width w is 100 to 500 mm.

* * * * *